US011137717B2

(12) United States Patent
Yoshimoto

(10) Patent No.: US 11,137,717 B2
(45) Date of Patent: Oct. 5, 2021

(54) PROCESS CARTRIDGE AND IMAGE FORMING APPARATUS

(71) Applicant: SHARP KABUSHIKI KAISHA, Sakai (JP)

(72) Inventor: Yuhsuke Yoshimoto, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/071,390

(22) Filed: Oct. 15, 2020

(65) Prior Publication Data

US 2021/0116861 A1 Apr. 22, 2021

(30) Foreign Application Priority Data

Oct. 16, 2019 (JP) ..... JP2019-189271

(51) Int. Cl.
*G03G 21/18* (2006.01)
*G03G 15/02* (2006.01)

(52) U.S. Cl.
CPC ..... *G03G 21/1814* (2013.01); *G03G 15/0216* (2013.01)

(58) Field of Classification Search
CPC ..... G03G 21/1814; G03G 15/0216
See application file for complete search history.

(56) References Cited

U.S. PATENT DOCUMENTS

| | | | | |
|---|---|---|---|---|
| 6,385,420 | B1 * | 5/2002 | Morioka | G03G 15/0216 399/115 |
| 2007/0138732 | A1 * | 6/2007 | Hackney | G03G 15/0216 271/10.09 |
| 2013/0121725 | A1 * | 5/2013 | Shirayanagi | G03G 21/1814 399/111 |
| 2013/0129385 | A1 * | 5/2013 | Kim | G03G 21/1814 399/115 |
| 2016/0216688 | A1 * | 7/2016 | Katayama | G03G 21/1814 |
| 2017/0139341 | A1 * | 5/2017 | Morishita | G03G 15/0225 |

FOREIGN PATENT DOCUMENTS

| | | |
|---|---|---|
| JP | 2005-338578 A | 12/2005 |
| JP | 2006-267399 A | 10/2006 |

* cited by examiner

*Primary Examiner* — Sandra Brase
(74) *Attorney, Agent, or Firm* — ScienBiziP, P.C.

(57) ABSTRACT

A process cartridge includes a photosensitive drum, a charge roller unit, and a storage recess. The photosensitive drum is disposed on a body frame. The charge roller unit includes a charge roller and is separate from the body frame. The storage recess stores the charge roller unit. The charge roller unit includes a storage frame and a support. The support supports the charge roller and is movably held on the storage frame. The support includes an operation portion that switches between a remote position and a contact position while the charge roller unit is stored in the storage recess. In the remote position, the charge roller is separated from the photosensitive drum. In the contact position, the charge roller is in contact with the photosensitive drum.

8 Claims, 16 Drawing Sheets

PROCESS CARTRIDGE AND IMAGE FORMING APPARATUS

BACKGROUND OF THE INVENTION

Field of the Invention

The present invention relates to a process cartridge including a charge roller and a photosensitive drum, and an image forming apparatus, more particularly to measures for improving maintenance workability, such as replacement of a charge roller.

Description of the Background Art

Conventionally, a process cartridge of an image forming apparatus includes a unit that integrates a charge roller and a photosensitive drum, to reduce the size of the process cartridge. The charge roller is often integrated with, for example, a charge cleaning roller, etc., into a charge roller unit.

During maintenance of the process cartridge, such as replacement of the charge roller, the photosensitive drum is removed first, and then the charge roller unit is removed so that the photoconductive surface of the photosensitive drum is not damaged. When the replaced charge roller unit is installed, the charge roller unit is installed first, and then the photosensitive drum is installed.

This process requires the detachment and attachment of the photosensitive drum in addition to the detachment and attachment of the charge roller unit. Therefore, in order to enhance the maintenance workability, it is desired that the charge roller unit be detached and attached while the photosensitive drum is installed to the process cartridge.

In such a case, the detachment and attachment of the charge roller unit require careful work by the worker so that the charge roller is constantly separated from the photosensitive drum. However, it is assumed that, sometimes, the charge roller may inadvertently come into contact with the surface of the photosensitive drum and cause damage, or a lubricant or the like applied to the photosensitive drum may adhere to the surface of the charge roller and cause poor charging.

Conventional techniques using a configuration in which a charge roller and a photosensitive drum are separated from each other include the techniques according to Japanese Unexamined Patent Publications No. 2005-338578 and No. 2006-267399.

Japanese Unexamined Patent Publication No. 2005-338578 discloses a configuration in which a charge roller can be moved (pulled out) farther than the charging position of a photosensitive drum in the axial direction, and only when the charge roller is retracted, the charge roller is cleaned by bringing a cleaning member of a cleaning means into contact with the charge roller while the charge roller is rotated in a state separated from the photosensitive drum. In Japanese Unexamined Patent Publication No. 2006-267399, a separating member that separates a charge roller from a photosensitive drum is detachably disposed on a process cartridge so as to prevent deformation of the charge roller caused by contact between the charge roller and the photosensitive drum before the time of use by the user.

However, although Japanese Unexamined Patent Publications No. 2005-338578 and No. 2006-267399 disclose configurations in which the charge roller and the photosensitive drum are separated from each other, the techniques do not provide measures for preventing damage to the surface of the photosensitive drum during maintenance, such as replacement of the charge roller.

An object of the present invention is to enable detachment and attachment of a charge roller unit from and to a process cartridge without damaging the surface of a photosensitive drum while the photosensitive drum is installed on the process cartridge, and to facilitate and enhance the efficiency of maintenance work, such as replacement of the charge roller.

SUMMARY OF THE INVENTION (First Configuration)

A process cartridge according to an aspect of the present invention includes a photosensitive drum disposed on a body frame; a charge roller unit that includes a charge roller disposed in parallel with an axial direction of the photosensitive drum and that is provided separately from the body frame; and a storage recess that stores the charge roller unit.

The charge roller unit includes a storage frame; and a support that supports the charge roller and is movably held relative to the storage frame.

The support includes an operation portion that switches between a remote position and a contact position.

The remote position is a position at which the charge roller is separated from the photosensitive drum while the charge roller unit is stored in the storage recess.

The contact position is a position at which the charge roller is in contact with the photosensitive drum while the charge roller unit is stored in the storage recess.

According to the configuration described above, the position of the charge roller can be switched to the remote position at which the charge roller is separated from the photosensitive drum by operating the operation portion of the charge roller unit. Therefore, the charge roller unit can be detached from and attached to the process cartridge without damage to the surface of the photosensitive drum while the photosensitive drum is attached to the process cartridge. In this way, maintenance work, such as replacement of the charge roller, can be facilitated and made efficient.

(Second Configuration)

According to the first configuration, in the charge roller unit, the charge roller may be switched to the remote position when the operation portion is operated, and the charge roller may be switched from the remote position to the contact position when the operation of the operation portion is released.

According to the configuration described above, the charge roller is switched to the remote position when the operation portion is operated, and the charge roller is switched from the remote position to the contact position when the operation of the operation portion is released. Therefore, by detaching or attaching the charge roller unit while the operation portion is operated, the charge roller unit can be detached from or attached to the process cartridge without damage to the surface of the photosensitive drum while the photosensitive drum is attached to the process cartridge.

(Third Configuration)

According to the first or second configuration, the charge roller may be positioned at a predetermined position on a rear side of the photosensitive drum when viewed from a direction in which the charge roller unit is inserted to the storage recess, and the charge roller unit may be detachable from and attachable to the storage recess by switching the support to the remote position while the charge roller is separated from the photosensitive drum.

According to the configuration described above, even when the charge roller is positioned on the rear side of the photosensitive drum, the charge roller unit can be detached from or attached to the storage recess while the charge roller is separated from the photosensitive drum by switching the support to the remote position. Therefore, the charge roller unit can be detached from and attached without damage to the surface of the photosensitive drum while the photosensitive drum is attached. In this way, maintenance work, such as replacement of the charge roller, can be facilitated and made efficient.

(Fourth Configuration)

According to any one of the first to third configurations, when a face viewed from a direction in which the charge roller unit is inserted to the storage recess is defined as a front face, the operation portion may extend toward the front face.

According to the configuration described above, the operation portion extends toward the front face. Thus, the operation portion can be readily operated when the charge roller unit is detached from or attached to the storage recess.

(Fifth Configuration)

According to any one of the first to third configurations, the operation portion may extend in an axial direction of the charge roller.

According to the configuration described above, the operation portion extends in the axial direction of the charge roller. Thus, the operation portion can be readily operated when the charge roller unit is detached from or attached to the storage recess.

(Sixth Configuration)

According to any one of the first to fifth configurations, the charge roller unit may include a retainer that retains the charge roller at the remote position.

According to the configuration described above, the charge roller unit includes a retainer that retains the charge roller at the remote position. Therefore, when the charge roller unit is to be detached from or attached to the storage recess, the position of the charge roller can be switched to the remote position in advance so as to facilitate the detachment and attachment of the charge roller unit.

(Seventh Configuration)

According to the sixth configuration, the storage recess may include a releaser that releases a retained state of the retainer and switches the charge roller from the remote position to the contact position, while the charge roller unit is stored in the storage recess.

According to the configuration described above, by storing the charge roller unit in the storage recess, the retained state of the retainer is released, and the position of the charge roller is switched from the remote position to the contact position. Therefore, the operation of releasing the retained state of the retainer is not required, and maintenance work, such as replacement of the charge roller, can be facilitated and made more efficient.

(Eighth Configuration)

An image forming apparatuses according to an aspect of the present invention includes the process cartridge having any one of the first to seventh configurations.

According to the configuration described above, the position of the charge roller can be switched to the remote position at which the charge roller is separated from the photosensitive drum by operating the operation portion of the charge roller unit. Therefore, the charge roller unit can be detached from and attached to the process cartridge without damage to the surface of the photosensitive drum while the photosensitive drum is attached to the process cartridge. In this way, maintenance work, such as replacement of the charge roller, can be facilitated and made efficient.

A process cartridge and an image forming apparatus according to some aspects of the present invention enable detachment and attachment of a charge roller unit from and to a process cartridge without damage to the surface of a photosensitive drum while the photosensitive drum is attached on the process cartridge. In this way, maintenance work, such as replacement of the charge roller, can be facilitated and made efficient.

DESCRIPTION OF THE PREFERRED EMBODIMENTS

Embodiments of the present invention will now be described with reference to the accompanying drawings.

First Embodiment

Figure 1:
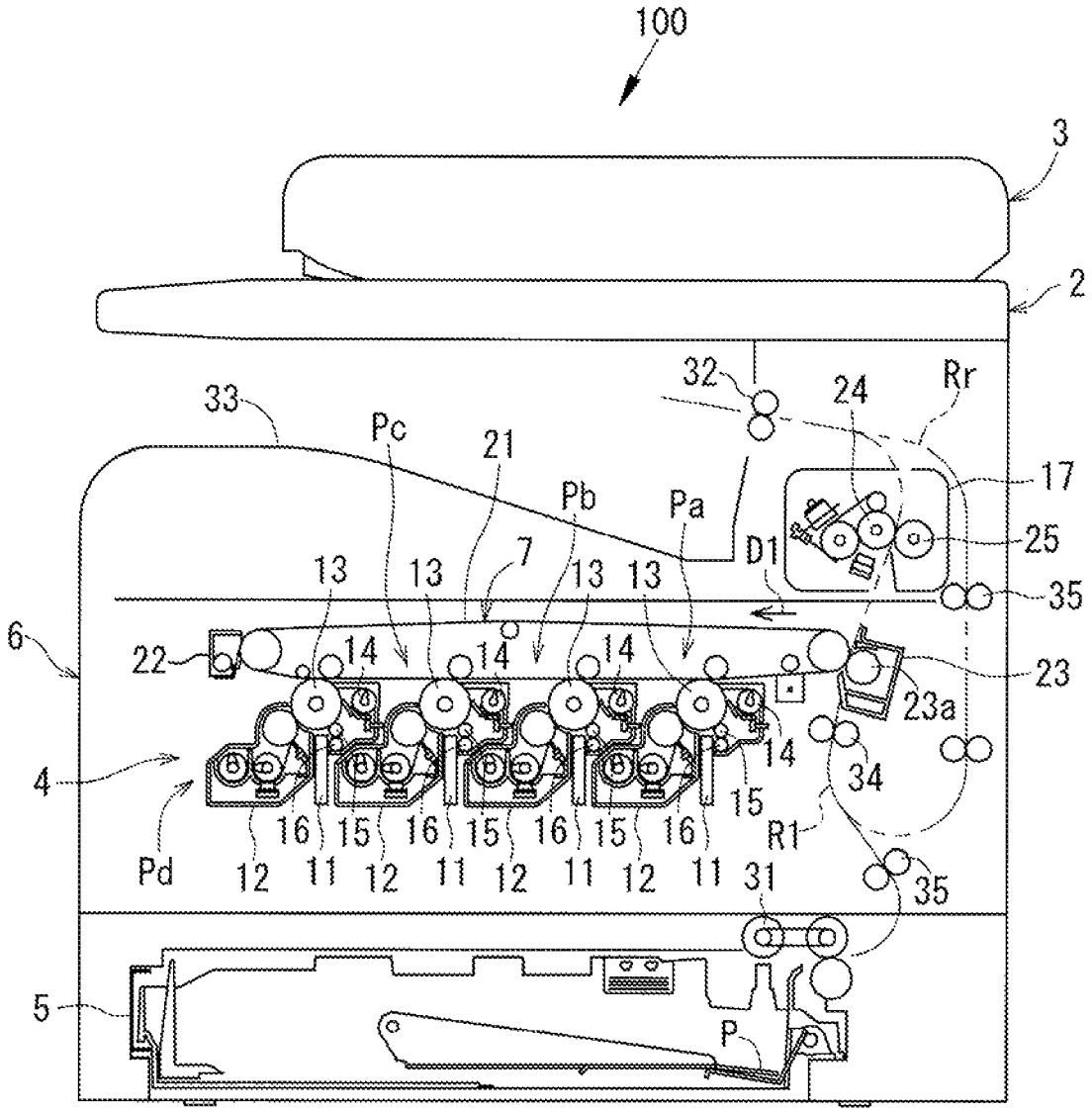
FIG. 1 is a cross-sectional view of the overall configuration of an image forming apparatus including a process cartridge according to a first embodiment, in view from the front.

FIG. 1 is a cross-sectional view of the overall configuration of an image forming apparatus 100 including a process cartridge 200 according to the present embodiment, in view from the front.

The image forming apparatus 100 has a copying function of reading a document and printing the read document on a recording sheet. As illustrated in FIG. 1, the image forming apparatus 100 includes an image reading device 2, an automatic document feeder (ADF) 3, a printing unit 4, and a paper feed cassette 5. The printing unit 4 and the paper feed cassette 5 are built in a body 6 of the image forming apparatus 100. The image reading device 2 and the ADF 3 are mounted on the upper portion of the body 6.

The image data processed by the image forming apparatus 100 corresponds to a color image in the colors black (K), cyan (C), magenta (M), and yellow (Y) or a monochrome image in a single color (for example, black). Therefore, the printing unit 4 includes four image stations Pa, Pb, Pc, and Pd associated with black, cyan, magenta, and yellow, each of which includes an LED head 11, a developing device 12, a photosensitive drum 13, a photoconductor cleaning device 14, a charge roller 15, a charge cleaning roller 16, etc. The image stations Pa, Pb, Pc, and Pd form four types of toner images corresponding to the respective colors.

In each of the image stations Pa, Pb, Pc, and Pd, the charge roller 15 uniformly charges the surface of the photosensitive drum 13 to a predetermined potential. The charge cleaning roller 16 removes and cleans the deposits on the surface of the charge roller 15.

The LED head 11 exposes the surface of the photosensitive drum 13 uniformly charged by the charge roller 15 in accordance with the image data, and forms an electrostatic latent image corresponding to the image data on the surface of the photosensitive drum 13. The developing device 12 develops the electrostatic latent image formed on the surface of the photosensitive drum 13 by the LED head 11 using a developing agent stored in a developing tank, and forms a toner image on the surface of the photosensitive drum 13.

A primary transfer device 7 primarily transfers the toner images of the respective colors formed on the surfaces of the photosensitive drums 13, in sequence to an intermediate transfer belt 21 and overlays the toner images, to form a color toner image on the intermediate transfer belt 21.

The photoconductor cleaning device 14 includes a cleaning member, such as a cleaning blade. While the intermediate transfer belt 21 rotates in the direction of arrow D1, the residual toner not transferred to the intermediate transfer belt 21 by the primary transfer device 7 and thus remaining on the surface of the photosensitive drum 13 is collected as a waste toner by the cleaning member and transported to a toner collection container (not illustrated).

A nip area is formed between the intermediate transfer belt 21 and a transfer roller 23*a* of a secondary transfer device 23. A recording sheet P transported through an S-shaped sheet transport path R1 is sandwiched in the nip area and transported.

The secondary transfer device 23 secondarily transfers the toner images primarily transferred to the intermediate transfer belt 21, to the recording sheet P. In this example, the secondary transfer device 23 includes a secondary transfer roller 23*a*. The secondary transfer roller 23*a* electrostatically transfers the toner images transferred to the intermediate transfer belt 21 by the primary transfer device 7 onto the recording sheet P to form unfixed toner images on the recording sheet P.

A belt cleaning device 22 collects the residual toner remaining on the intermediate transfer belt 21 without being transferred to the recording sheet P by the secondary transfer device 23 as a waste toner, and transports the waste toner to the collection container.

The fixing device 17 receives the recording sheet P on which the unfixed toner image is transferred. The recording sheet P is transported between a heating roller 24 and a pressing roller 25 while being subjected to heating and pressurization, to thermally fix the respective color toner images transferred on the recording sheet P.

The recording sheet P is pulled out from the paper feed cassette 5 by a pick-up roller 31, transported through the sheet transport path R1, and output to a sheet receiving tray 33 through a discharge roller 32 after passing through the secondary transfer device 23 and the fixing device 17. The sheet transport path R1 is provided with a register roller 34, a transport roller 35, etc. The register roller 34 temporarily stops the recording sheet P, aligns the leading edge of the recording sheet P, and starts the transport of the recording sheet P at a toner-image transfer timing in the nip area between the intermediate transfer belt 21 and the transfer roller 23*a*. The transport roller 35 prompts the transport of the recording sheet P.

When printing is performed on the back face of the recording sheet P as well as the front face, the recording sheet P is transported in the reverse direction from each discharge roller 32 to a reversing path Rr; the front and back of the recording sheet P are reversed; the recording sheet P is guided to each of the register rollers 34 again; an image is recorded and fixed on the back face of the recording sheet P as on the front face of the recording sheet P; and the recording sheet P is output to the sheet receiving tray 33.

Process Cartridge

Figure 2:
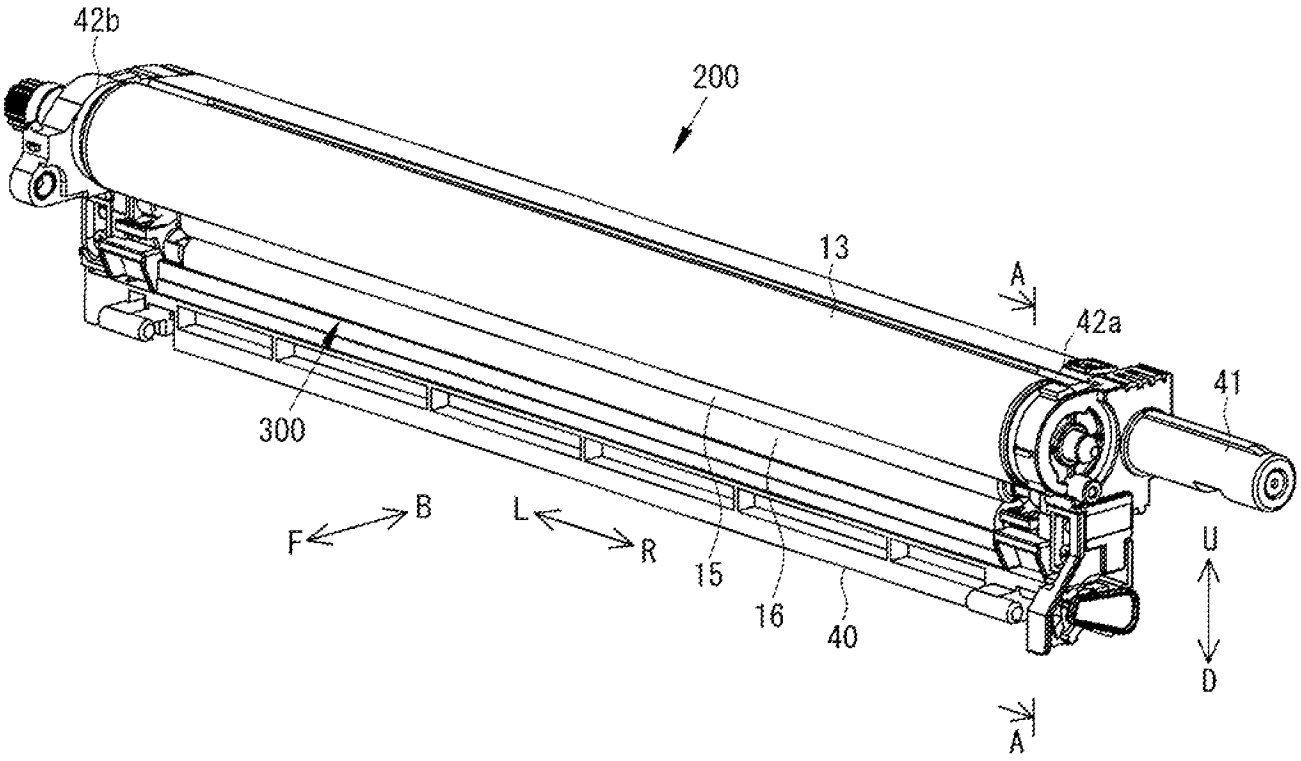
FIG. 2 is a perspective view of the overall configuration of a process cartridge.

The photosensitive drum 13, the charge roller 15, and the charge cleaning roller 16 are integrated into a process cartridge 200 (see FIG. 2). As illustrated in FIG. 1, the process cartridge 200 is attached to the image forming apparatus 100 such that the axial direction of the photosensitive drum 13, the charge roller 15, and the charge cleaning roller 16 is aligned in the front-back direction (the direction perpendicular to FIG. 1) of the image forming apparatus 100.

As illustrated in FIG. 1, the charge roller 15 is disposed such that its surface is in contact with the surface of the photosensitive drum 13 at the lower right side of the photosensitive drum 13, specifically, at a position of about 5 o'clock, in view from the front side of the image forming apparatus 100. The charge roller 15 has a function of uniformly charging the surface of the photosensitive drum 13 to a predetermined potential. The charge cleaning roller 16 is disposed directly below and in contact with the charge roller 15. The process cartridge 200 can be pulled out from and inserted to the front of the image forming apparatus 100.

Figure 3:
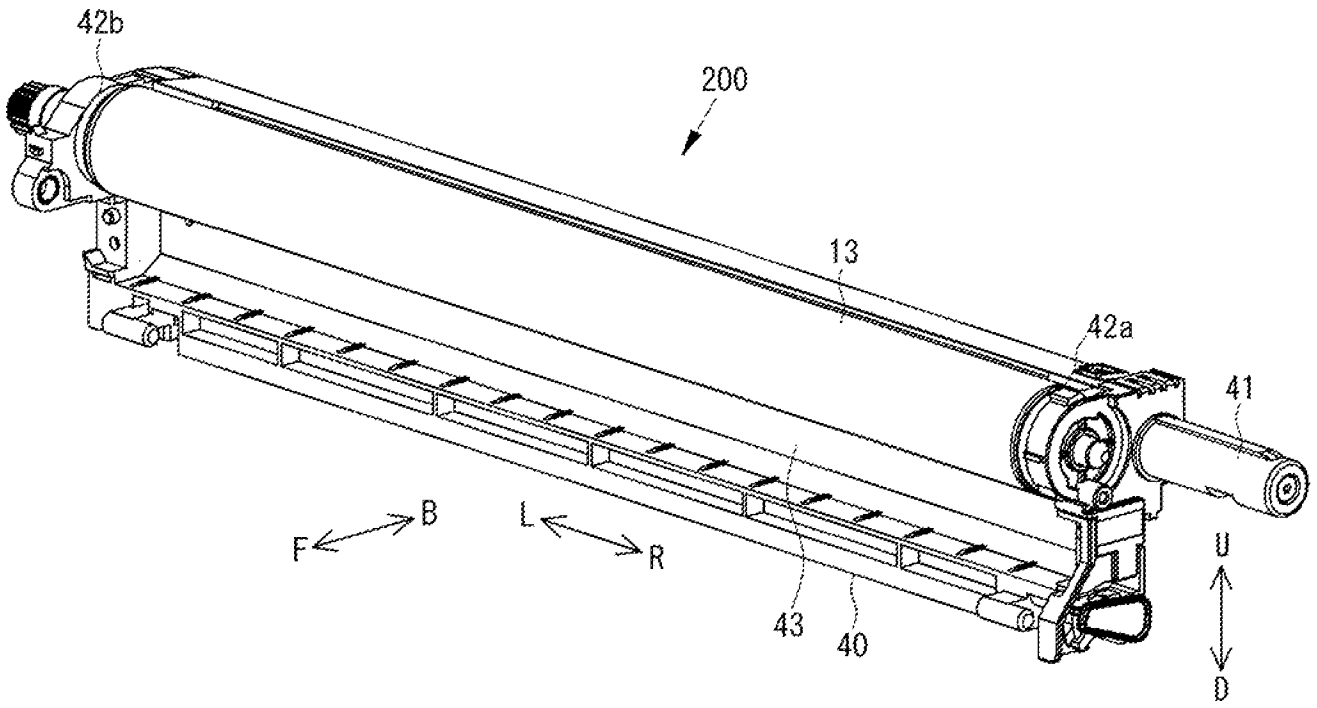
FIG. 3 is a perspective view of a process cartridge with a charge roller unit removed.

FIG. 2 is a perspective view of the overall configuration of the process cartridge 200. FIG. 3 is a perspective view of the process cartridge 200 with a charge roller unit 300 removed.

When the process cartridge 200 is attached to the image forming apparatus 100, as illustrated in FIG. 2, the process cartridge 200 is inserted into the image forming apparatus 100 from the left end portion in the drawing. When the attachment is completed, the right end portion in the drawing is disposed on the front side of the image forming apparatus 100. Note that, in the following description of the process cartridge 200 and the charge roller unit 300, the left side of the process cartridge 200 and the charge roller unit 300 is denoted by L, and the right side is denoted R. The front side of the process cartridge 200 and the charge roller unit 300 is denoted by F, and the rear side is denoted B. The upper side of the process cartridge 200 and the charge roller unit 300 is denoted by U, and the right side is denoted by D.

The process cartridge 200 includes a body frame 40 extending in the left-right direction. Circular openings 42*a* and 42*b* for inserting the photosensitive drum 13 are formed at the left and right ends of the body frame 40. The left and right ends of the photosensitive drum 13 are inserted to the openings 42*a* and 42*b*, respectively, to rotatably attach the photosensitive drum 13 to the body frame 40 so that the axial direction of the photosensitive drum 13 is aligned in the left-right direction. In the body frame 40, a rotary shaft 41 is disposed such that the axial direction of the rotary shaft 41 is aligned in the left-right direction. The right end of the rotary shaft 41 projects rightward from the right end of the body frame 40. The rotary shaft 41 rotationally drives a screw (not illustrated) for transporting the residual toner, as a waste toner, remaining on the surface of the photosensitive drum 13 collected by the photoconductor cleaning device 14 into the toner collection container.

In the process cartridge 200, the charge roller 15 and the charge cleaning roller 16 are disposed in parallel with the photosensitive drum 13 with the axial direction aligned in the left-right direction. The charge roller 15 and the charge cleaning roller 16 are integrated into the charge roller unit 300. The charge roller unit 300 is provided as a separate body that is detachable from the body frame 40 of the process cartridge 200. As illustrated in FIG. 3, the body frame 40 has a long storage recess 43 that extends in the left-right direction and opens to the front so as to store the charge roller unit 300 therein.

Referring back to FIG. 2, the charge roller 15 is disposed at a position closer to the rear side of the process cartridge 200 than the photosensitive drum 13 and below the photosensitive drum 13, specifically, at a position of about a 5 o'clock (see FIG. 1), in view from the right side of the process cartridge 200. The surface of the charge roller 15 is in contact with the surface of the photosensitive drum 13. The charge cleaning roller 16 is disposed directly below the charge roller 15. The surface of the charge cleaning roller 16 is in contact with the surface of the charge roller 15.

Charge Roller Unit

Figure 4:
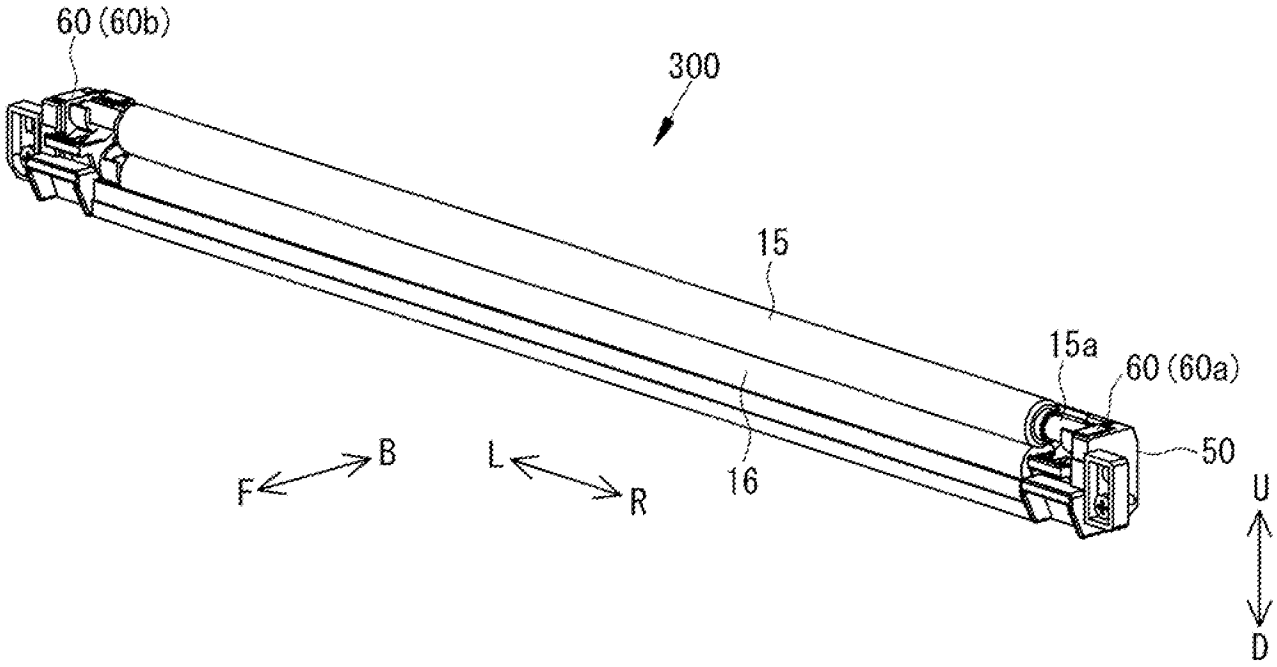
FIG. 4 is a perspective view of the overall configuration of a charge roller unit.

FIG. 4 is a perspective view of the overall configuration of the charge roller unit 300. As illustrated in FIG. 4, the charge roller unit 300 includes a housing frame 50 and a support 60. The housing frame 50 extends in the left-right direction. The housing frame 50 houses the charge roller 15 and the charge cleaning roller 16.

The support 60 has a right support portion 60*a* and a left support portion 60*b*. The right support portion 60*a* is disposed at the right end of the housing frame 50, and the left support portion 60*b* is disposed at the left end of the housing frame 50. The right support portion 60*a* and the left support portion 60*b* support the charge roller 15 and the charge cleaning roller 16. The right support portion 60*a* and the left support portion 60*b* have substantially bilaterally symmetrical shapes. Therefore, in the following description, the right support portion 60*a* will be mainly described, and the detailed description of the left support portion 60*b* will be omitted. The right support portion 60*a* and the left support portion 60*b* may be simply referred to as the support 60.

Figure 5:
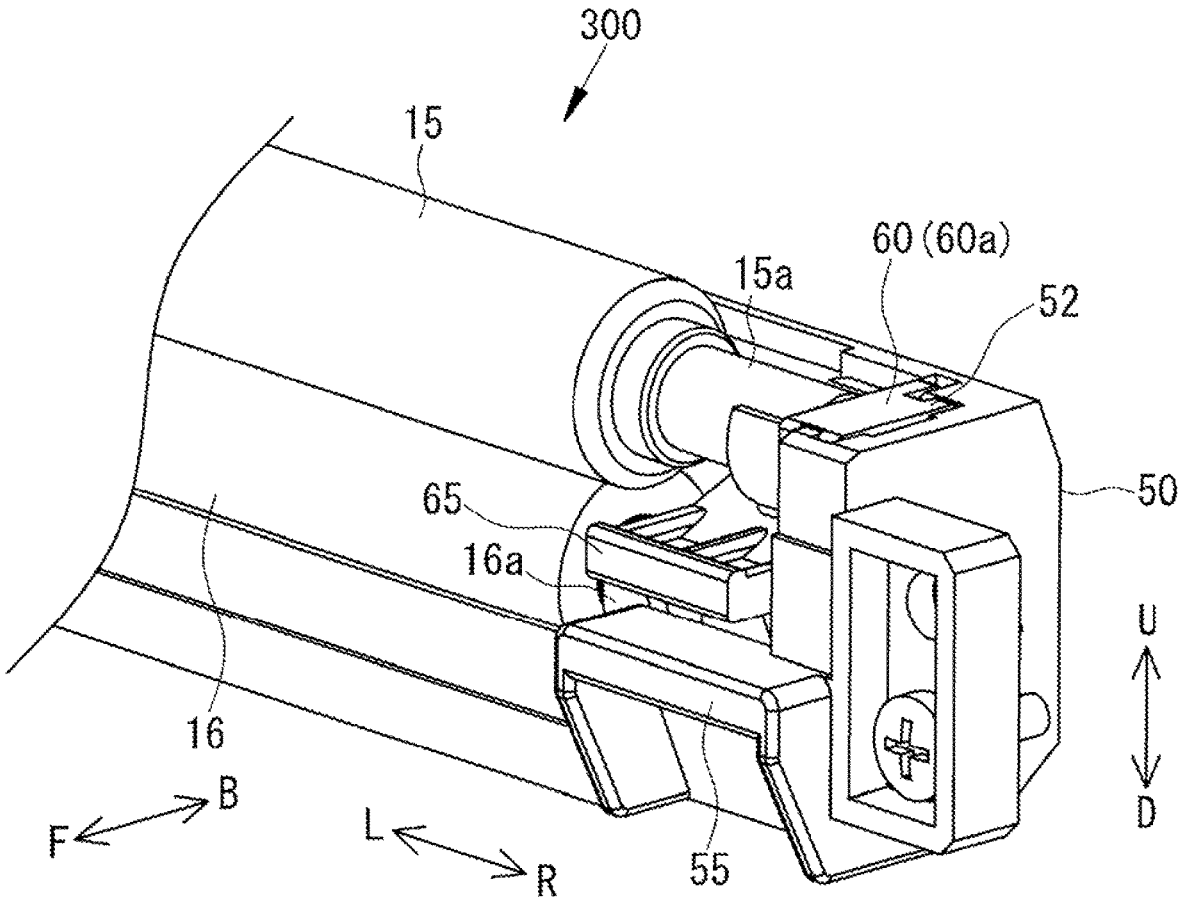
FIG. 5 is an enlarged perspective view of the right end portion of a charge roller unit.

FIG. 5 is an enlarged perspective view of the right end portion of the charge roller unit 300. As illustrated in FIG. 5, the support 60 supports a shaft 15*a* of the charge roller 15 and a shaft 16*a* of the charge cleaning roller 16. The support 60 is held so as to be vertically movable relative to the housing frame 50. The housing frame 50 has a guide 52 that guides the support 60 in the vertical direction. The support 60 has an operation portion 65. By operating the operation portion 65 in the vertical direction, the position of the charge roller 15 can be switched in the vertical direction (see FIGS. 8A, 8B, 9A, and 9B).

Figure 8A:
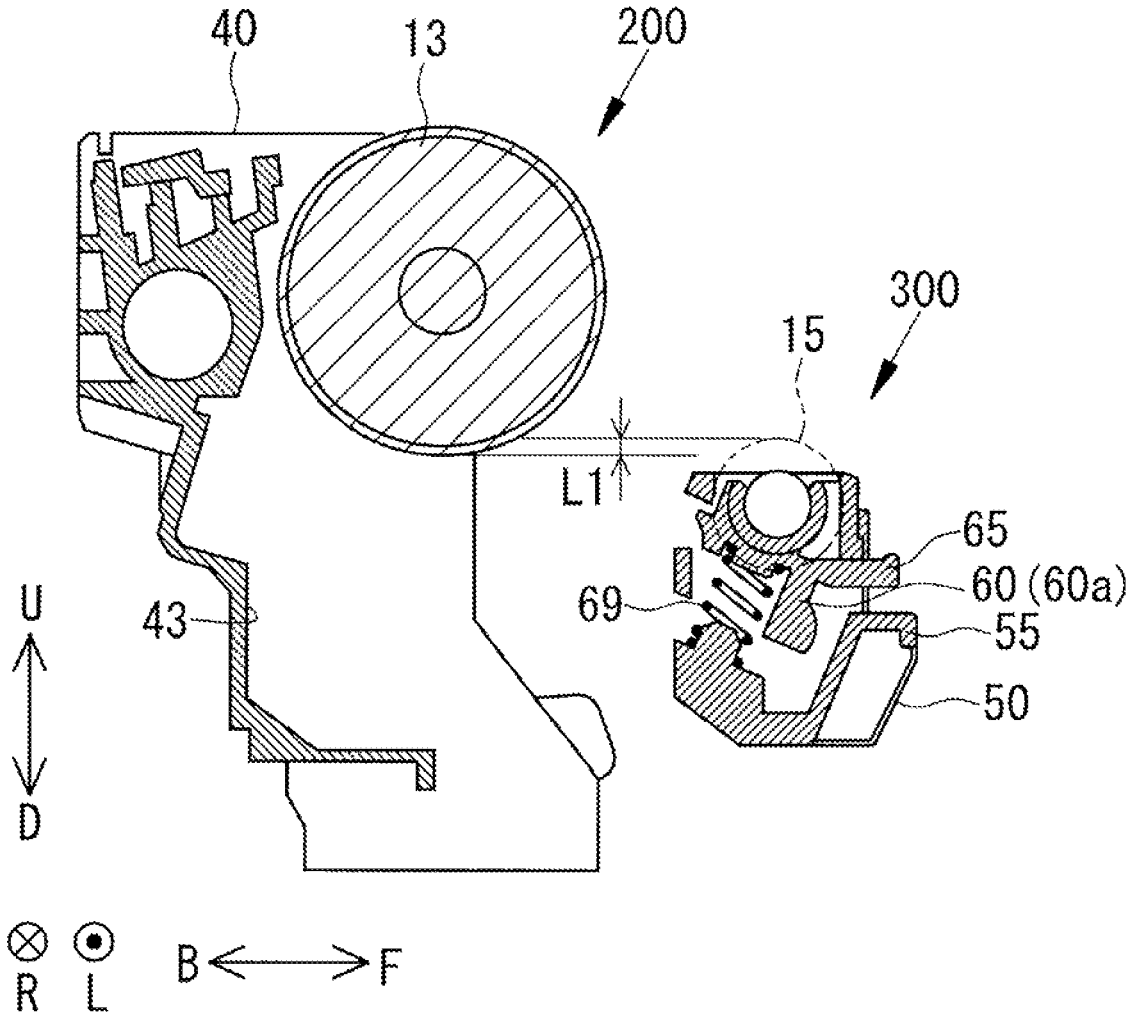
FIG. 8A is a cross-sectional view of a process cartridge and a charge roller unit in a state in which the charge roller unit is to be attached to the process cartridge.
Figure 8B:
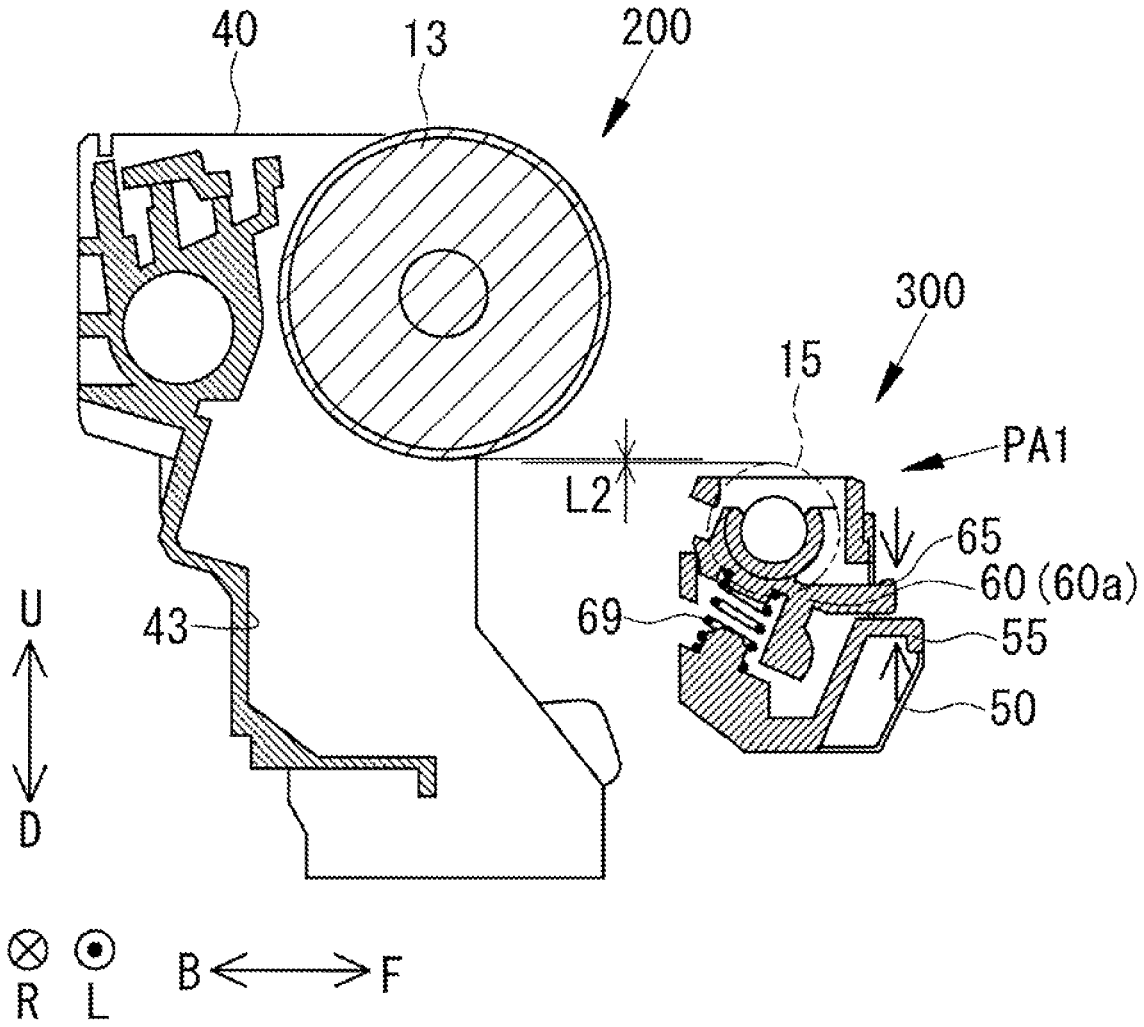
FIG. 8B is a cross-sectional view of a process cartridge and a charge roller unit in a state in which the charge roller unit is to be attached to the process cartridge.

The support 60 is urged upward by an urging member 69 (see FIGS. 8A and 8B). Thus, the charge roller 15 is located at the highest position when the operation portion 65 is not operated (see FIG. 8A). When the charge roller unit 300 is stored in the storage recess 43 of the process cartridge 200, the charge roller 15 is slightly pushed down from the uppermost position and is urged toward the photosensitive drum 13. The position at which the charge roller 15 comes into contact with the photosensitive drum 13 while the charge roller unit 300 is stored in the storage recess 43 of the process cartridge 200 is referred to as a contact position PA2 (see FIG. 9B).

When the operation portion 65 is pushed down to counteract the urging force of the urging member 69, the charge roller 15 is positioned below the contact position PA2. The position at which the charge roller 15 is separated from the photosensitive drum 13 while the charge roller unit 300 is stored in the storage recess 43 of the process cartridge 200 is referred to as a remote position PA1 (see FIG. 8B).

The housing frame 50 has an operation grip 55. The operation grip 55 is disposed below the operation portion 65. The user can hold the operation portion 65 and the operation grip 55 with their fingers and push down the operation portion 65 relative to the operation grip 55, to switch the position of the charge roller 15 from the contact position PA2 to the remote position PA1. The user can release the operation portion 65 from the pushed-down state to switch the position of the charge roller 15 from the remote position PA1 to the contact position PA2.

Figure 6:
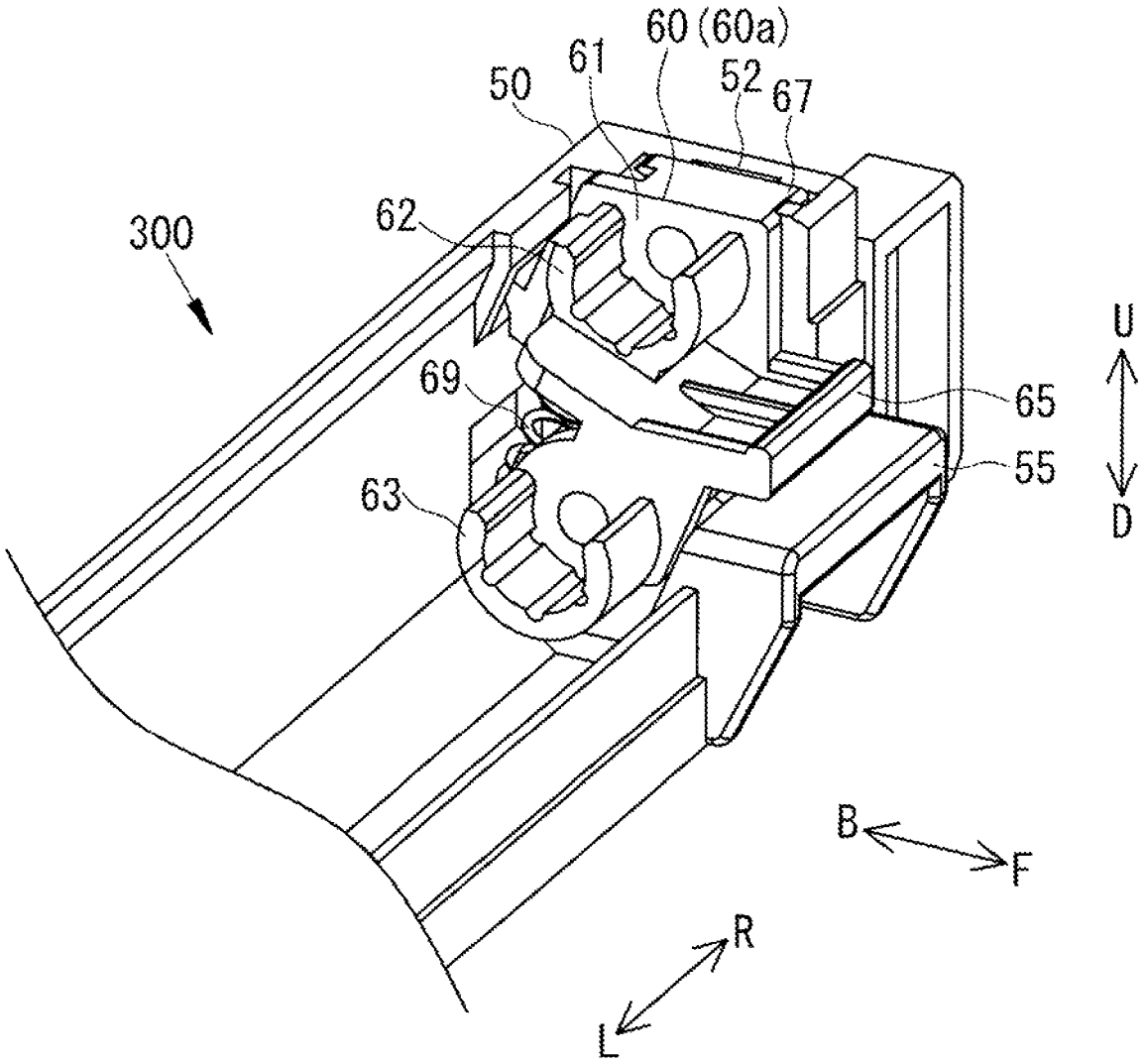
FIG. 6 is an enlarged perspective view of the right end portion of a charge roller unit.
Figure 7:
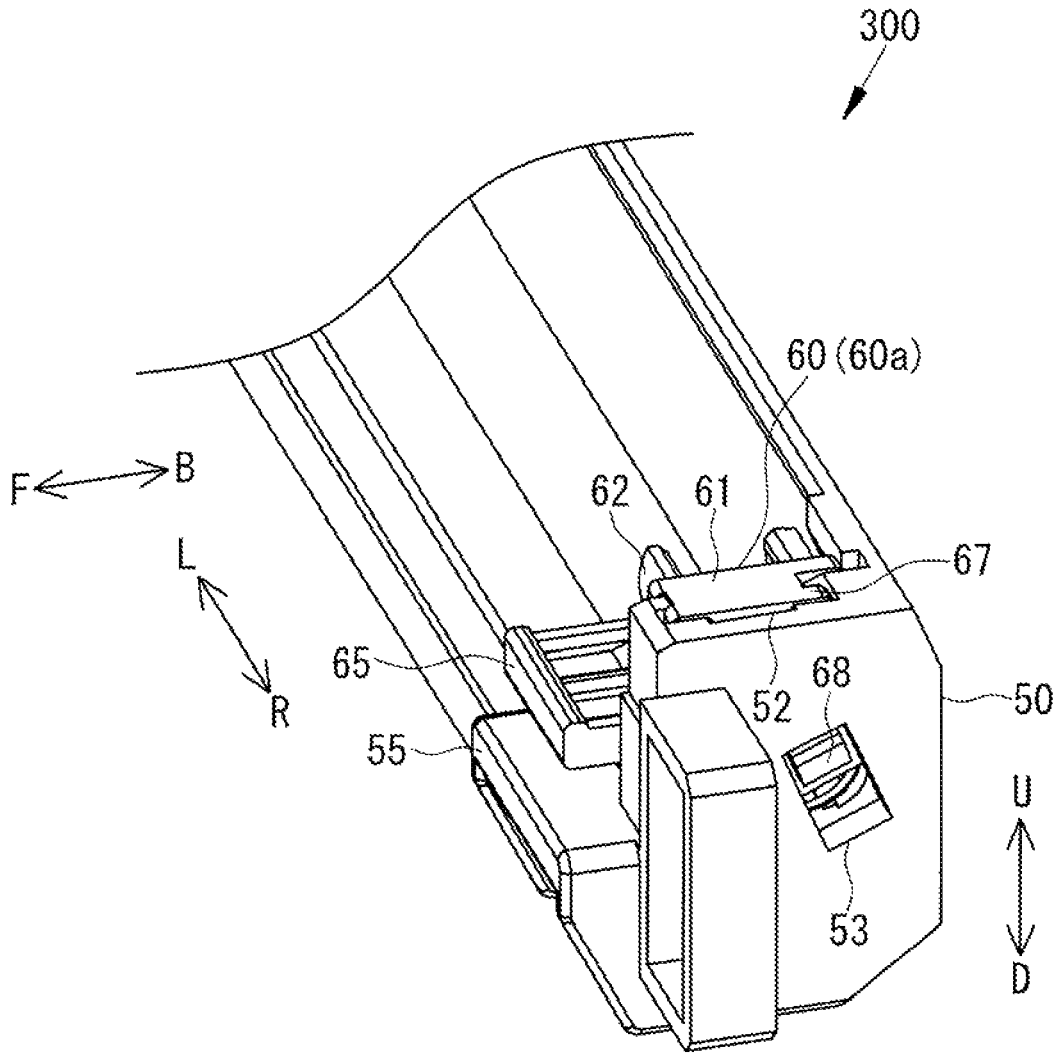
FIG. 7 is an enlarged perspective view of the right end portion of a charge roller unit.

FIGS. 6 and 7 are enlarged perspective views of the right end portion of the charge roller unit 300. In FIG. 6, the charge roller 15 and the charge cleaning roller 16 are removed from the support 60. FIG. 7 illustrates the right end portion of the charge roller unit 300 viewed from the right. As illustrated in FIGS. 6 and 7, the support 60 has a support body 61, a bearing 62, a bearing 63, an operation portion 65, a guided portion 67, a restricted portion 68, and an urging member 69.

The support body 61 is the base of the support 60.

The bearings 62 and 63 are disposed on the support body 61 and protrude toward the center in the longitudinal direction of the charge roller unit 300. The bearings 62 and 63 support the charge roller 15 and the charge cleaning roller 16. Each of the left and right ends of the shaft 15*a* of the charge roller 15 is removably inserted into the corresponding bearing 62. The bearing 63 is disposed below the bearing 62. Each of the left and right ends of the shaft 16*a* of the charge roller unit 16 is removably inserted into the corresponding bearing 63.

The operation portion 65 extends forward from the support body 61.

The guided portion 67 is disposed remote from (toward the ends of) the center in the longitudinal direction of the charge roller unit 300 relative to the support body 61. The housing frame 50 has a groove-shaped guide 52 extending in the vertical direction. The guided portion 67 is movable in the vertical direction along the guide 52.

The restricted portion 68 is disposed remote from (toward the ends of) the center in the longitudinal direction of the charge roller unit 300 relative to the guided portion 67 (see FIG. 7). The housing frame 50 has an elongated hole-shaped restricting portion 53 extending in the vertical direction. The restricted portion 68 is vertically movable along the restricting portion 53. The movable range of the support 60 relative to the housing frame 50 is limited by the restricted portion 68 coming into contact with the upper and lower edges of the restricting portion 53.

The urging member 69 urges the support body 61 upward relative to the housing frame 50. The urging member 69 is, for example, a coil spring. As described above, the support 60 (the charge roller 15) is located at the highest position when the operation portion 65 is not operated. When the operation portion 65 is pushed down to counteract the urging force of the urging member 69, the support 60 (the charge roller 15) is positioned below the contact position PA2 (at the remote position PA1).

The urging member 69 is disposed in parallel with the line connecting the shaft center of the charge roller 15 and the shaft center of the photosensitive drum 13 (see FIGS. 8A, 8B, 9A, and 9B). When the surface of the photosensitive drum 13 is charged by the charge roller 15, the charge roller 15 is urged toward the photosensitive drum 13 by the urging member 69 so that the surface of the charge roller 15 is pressed against the surface of the photosensitive drum 13.

Operation

The attachment of the charge roller unit 300 to the process cartridge 200 will now be described. FIGS. 8A, 8B, 9A, and 9B are cross-sectional views of the process cartridge 200 and the charge roller unit 300 in states in which the charge roller unit 300 is to be attached to the process cartridge 200. FIGS. 8A, 8B, 9A, and 9B illustrate cross-sections taken along line A-A in FIG. 2.

FIG. 8A illustrates a state before the charge roller unit 300 is attached to the storage recess 43 in the process cartridge 200. In FIG. 8A, the operation portion 65 is not operated. Therefore, the charge roller 15 is at the uppermost position relative to the housing frame 50. In this state, the upper edge of the charge roller 15 is positioned higher than the lower edge of the photosensitive drum 13 by a distance L1. As a result, if the charge roller unit 300 is attached to the storage recess 43 in the process cartridge 200 while the charge roller 15 is at the uppermost position, the charge roller 15 interferes with the photosensitive drum 13.

FIG. 8B illustrates a state in which the operation portion 65 of the process cartridge 200 is being operated. As illustrated in FIG. 8B, the user can switch the position of the charge roller 15 to the remote position PA1 by holding the operation portion 65 and the operation grip 55 with their fingers and pushing down the operation portion 65 relative to the operation grip 55. At the remote position PA1, the upper edge of the charge roller 15 is positioned lower than the lower edge of the photosensitive drum 13 by a distance L2. Note that the operation portion 65 is disposed at each of the left and right ends of the charge roller unit 300. Therefore, the user can hold the charge roller unit 300 with both hands while operating the left and right operation portions 65.

Figure 9A:
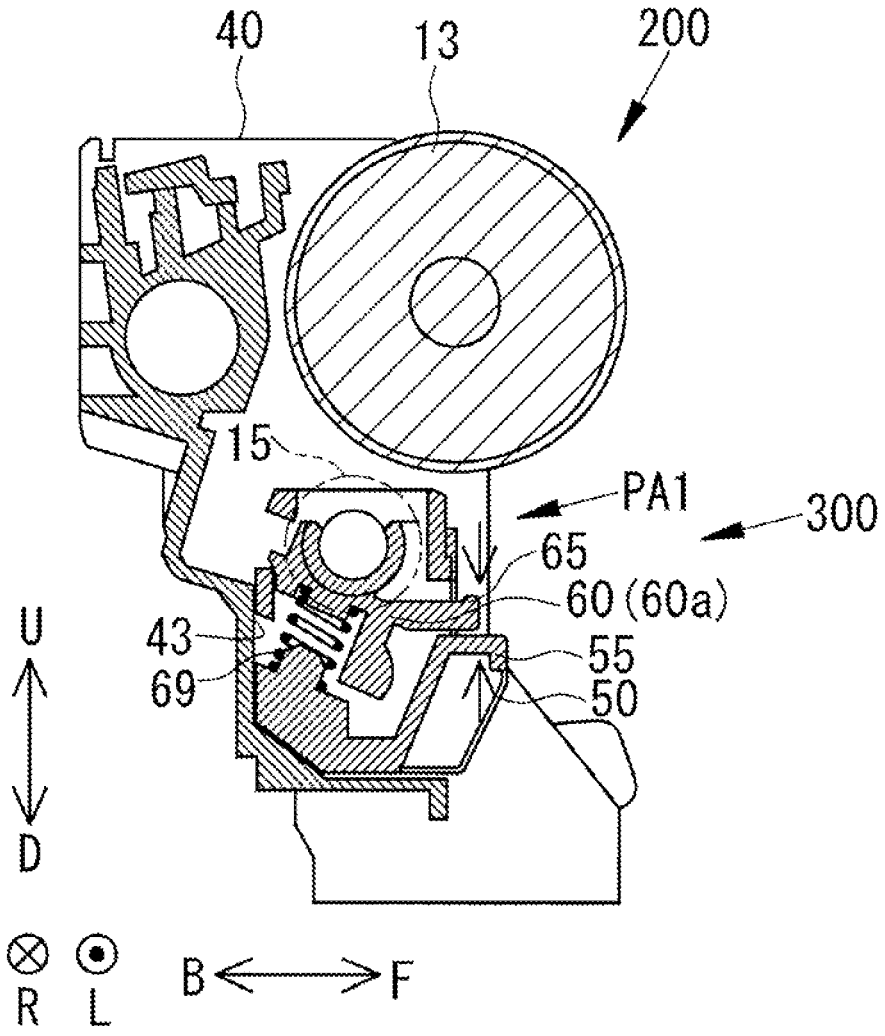
FIG. 9A is a cross-sectional view of a process cartridge and a charge roller unit in a state in which the charge roller unit is attached to the process cartridge.

FIG. 9A illustrates a state in which the charge roller unit 300 is attached to the storage recess 43 in the process cartridge 200 while the operation portion 65 of the process cartridge 200 is being operated. As described above, when the position of the charge roller 15 is switched to the remote position PA1, the upper edge of the charge roller 15 is positioned lower than the lower edge of the photosensitive drum 13. Therefore, when the position of the charge roller 15 is switched to the remote position PA1, the charge roller unit 300 can be attached to the storage recess 43 in the process cartridge 200 without causing the charge roller 15 to interfere with the photosensitive drum 13.

Figure 9B:
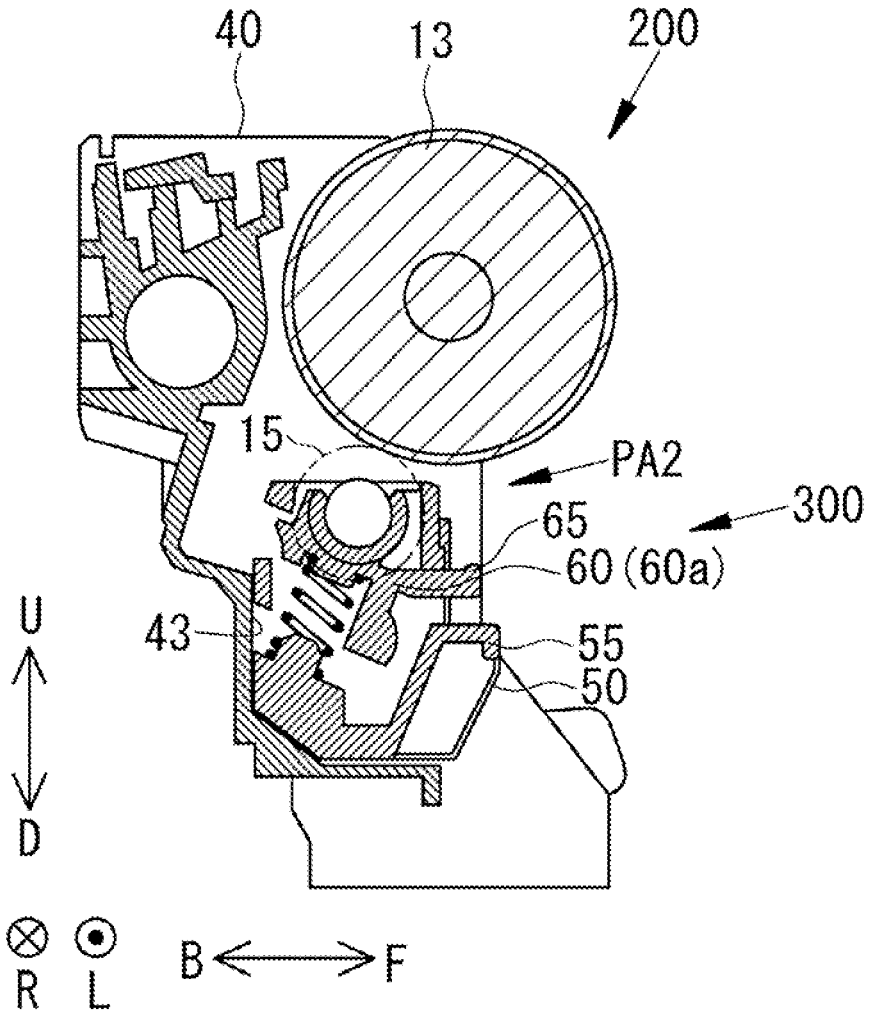
FIG. 9B is a cross-sectional view of a process cartridge and a charge roller unit in a state in which the charge roller unit is attached to the process cartridge.

FIG. 9B illustrates a state in which the operation portion 65 is released while the charge roller unit 300 is attached to the storage recess 43 in the process cartridge 200. As illustrated in FIG. 9B, the user can release the pushed-down operation portion 65 to switch the position of the charge roller 15 from the remote position PA1 to the contact position PA2. At the contact position PA2, the charge roller 15 is urged toward the photosensitive drum 13 by the urging member 69, and the surface of the charge roller 15 is pressed against the surface of the photosensitive drum 13.

As illustrated in FIG. 9B, the charge roller 15 is positioned at a predetermined position on the rear side of the photosensitive drum 13 when viewed from the direction (front to rear direction) in which the charge roller unit 300 is inserted to the storage recess 43. The charge roller unit 300 can be attached to the storage recess 43 while the charge roller 15 is separated from the photosensitive drum 13 by switching the position of the charge roller 15 to the remote position PA1.

When the charge roller unit 300 is to be removed from the storage recess 43 in the process cartridge 200, a procedure opposite to that of the attachment procedure is performed. First, the operation portion 65 is pushed down to switch the position of the charge roller 15 from the contact position PA2 to the remote position PA1, i.e., from the state illustrated in FIG. 9B to that in FIG. 9A. While the position of the charge roller 15 is kept at the remote position PA1, the charge roller unit 300 is removed from the storage recess 43 in the process cartridge 200 as illustrated in FIG. 8B. Then, as illustrated in FIG. 8A, the removal of the charge roller unit 300 from the process cartridge 200 is completed by the user releasing the pushed-down state of the operation portion 65.

With the process cartridge 200 according to the embodiment described above, the position of the charge roller 15 can be switched to the remote position PA1 at which the charge roller 15 is separated from the photosensitive drum 13 by operating the operation portion 65 of the charge roller unit 300. Therefore, the charge roller unit 300 can be detached from and attached to the process cartridge 200 without damage to the surface of the photosensitive drum 13 while the photosensitive drum 13 is attached to the process cartridge 200. In this way, maintenance work, such as replacement of the charge roller 15, can be facilitated and made efficient.

Second Embodiment

The second embodiment differs from the first embodiment in that an operation portion 65A is provided that extends in the axial direction of the charge roller 15. In the following description, the same components as those in the first embodiment are denoted by the same reference numerals, and the description thereof will be omitted. Only the configurations different from the first embodiment will be described.

Figure 10:
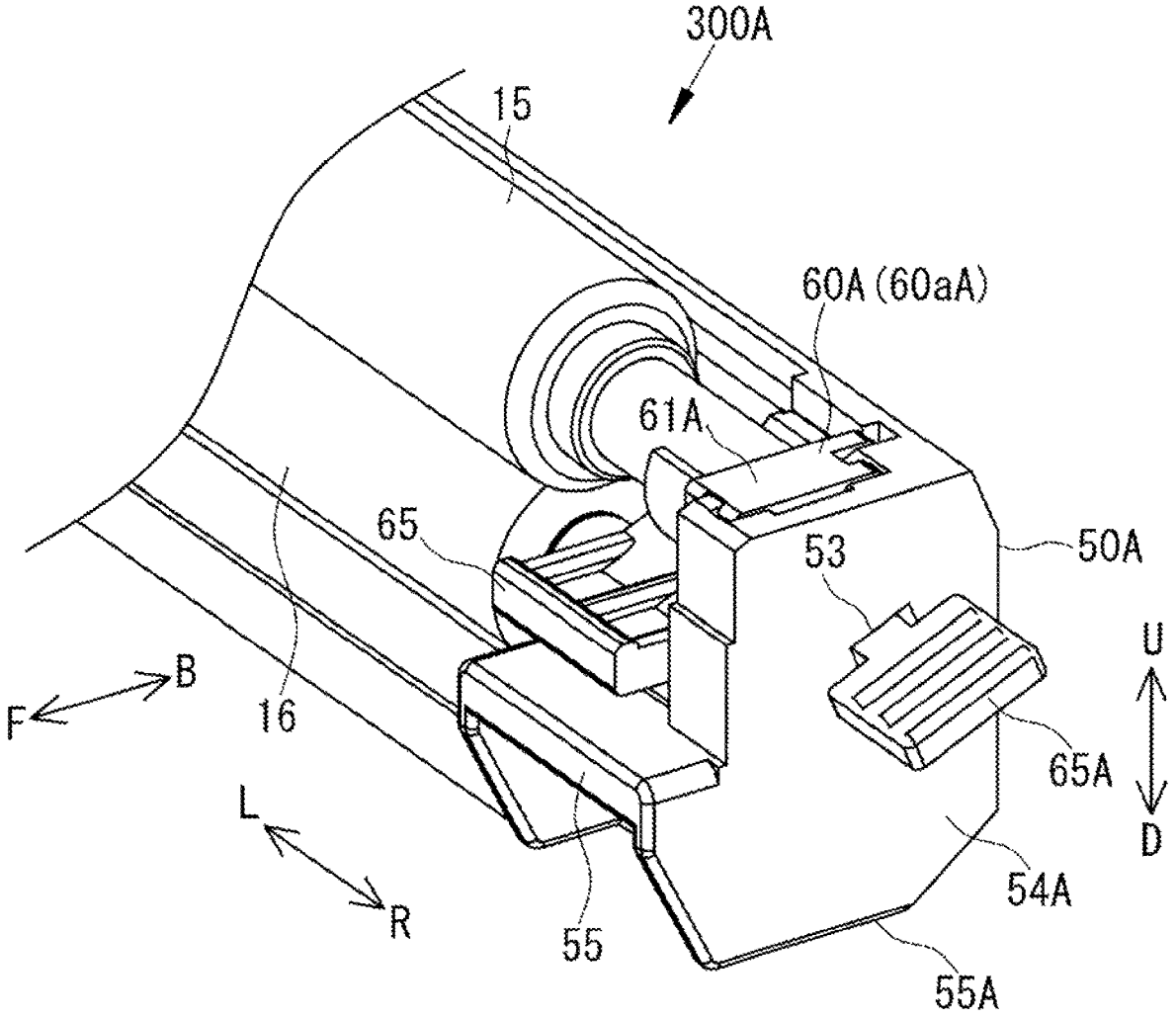
FIG. 10 is an enlarged perspective view of the right end portion of a charge roller unit to be attached to a process cartridge according to a second embodiment.

FIG. 10 is an enlarged perspective view of the right end portion of a charge roller unit 300A that is to be attached to a process cartridge 200A according to the second embodiment. As illustrated in FIG. 10, the operation portion 65A as well as the operation portion 65 are disposed on a support 60A (right support section 60*a*A and left support section 60*b*A) disposed at the left and right ends of a housing frame 50A.

The operation portion 65A extends in the axial direction of the charge roller 15 relative to a support body 61A. The operation portion 65A passes through the restricting portion 53 that is an elongated hole extending in the vertical direction in the housing frame 50A.

The lower portion of a sidewall 54A of the housing frame 50A serves as an operation grip 55A. The user holds the operation portion 65A and the operation grip 55A with their fingers and pushes down the operation portion 65A relative to the operation grip 55A, to switch the position of the charge roller 15 from the contact position PA2 to the remote position PA1. The user can release the operation portion 65 from the pushed-down state to switch the position of the charge roller 15 from the remote position PA1 to the contact position PA2.

In this embodiment, the operation portion 65A extends in the axial direction of the charge roller 15 relative to the support body 61A. Thus, the operation portion 65A can be readily operated when the charge roller unit 300A is detached from or attached to the storage recess 43.

In this embodiment, the operation portion 65A is disposed at each of the left and right ends of the charge roller unit 300A. Therefore, the user can hold the charge roller unit 300A with both hands while operating the left and right operation portions 65A.

Since the operation portions 65A are disposed at the left and right ends of the charge roller unit 300A, the operation portions 65A can be operated at a position farther from the photosensitive drum 13, and the photosensitive drum 13 can be prevented from coming into contact with fingers. As a result, it is possible to prevent image defects due to fingers coming into contact with the photosensitive drum 13 and causing fingerprints, sebum, and other substances to adhere to the surface of the photosensitive drum 13.

Third Embodiment

The third embodiment differs from the first embodiment in that it includes a retainer 80 that retains the charge roller 15 at the remote position PA1 and a releaser 90 that releases the retained state of the retainer 80. In the following description, the same components as those in the first embodiment are denoted by the same reference numerals, and the description thereof will be omitted. Only the configurations different from the first embodiment will be described.

Figure 11A:
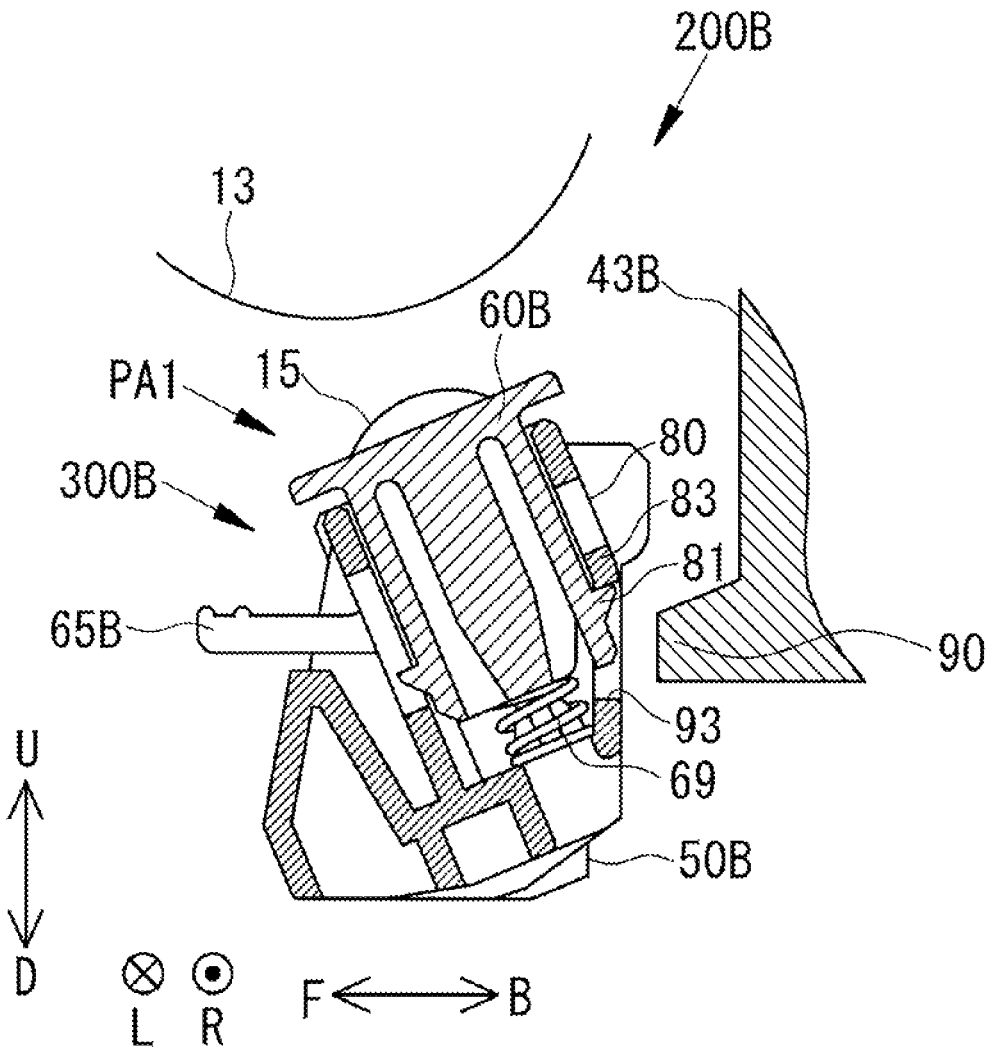
FIG. 11A is a cross-sectional view of a process cartridge and a charge roller unit according to a third embodiment in a state in which the charge roller unit is to be attached to the process cartridge.

FIGS. 11A, 11B, 12A, and 12B are cross-sectional views of a process cartridge 200B and a charge roller unit 300B according to the third embodiment in states in which the charge roller unit 300B is to be attached to the process cartridge 200B. As illustrated in FIG. 11A, the charge roller unit 300B includes a retainer 80. The retainer 80 retains the charge roller 15 at the remote position PA1. The retainer 80 has a latch 81 and a latched portion 83.

The latch 81 is disposed on a support 60B, and the latched portion 83 is disposed on a housing frame 50B. The latch 81 is elastically deformable into a latched state in which the latch 81 is engaged with the latched portion 83 (see FIG. 11A) and a released state in which engagement of the latch 81 to the latched portion 83 is released (see FIGS. 12A and 12B).

The latched portion 83 is the edge portion of a release hole 93 formed in the housing frame 50B. The latch 81 engages with the latched portion 83 when the charge roller 15 is at the remote position PA1, thereby to retain the position (the remote position PA1) of the charge roller 15 (the support 60B) to counteract the urging force of the urging member 69.

The positions and shapes of the latch 81 and the latched portion 83 of the retainer 80 are set so that the latch 81 engages with the latched portion 83 when the charge roller 15 is at the remote position PA1.

The releaser 90 is disposed in a storage recess 43B in the process cartridge 200B. The releaser 90 is disposed at a position where the releaser 90 can be passed through the release hole 93 formed in the housing frame 50B while the charge roller unit 300B is attached to the storage recess 43B in the process cartridge 200B. The releaser 90 passes through the release hole 93 and comes into contact with the latch 81, to cause the latch 81 to be pushed by the releaser 90 and release the engagement with the latched portion 83. In other words, the releaser 90 releases the retained state of the retainer 80 while the charge roller unit 300B is stored in the storage recess 43B, and switches the position of the charge roller 15 from the remote position PA1 to the contact position PA2.

Operation

The case in which the charge roller unit 300B is attached to the process cartridge 200B will now be described. FIG. 11A illustrates a state in which the charge roller unit 300B is being attached to the storage recess 43B in the process cartridge 200B. In FIG. 11A, the charge roller 15 is positioned at the remote position PAL The latch 81 and the latched portion 83 of the retainer 80 are engaged with each other to retain the position (the remote position PA1) of the charge roller 15 (the support 60B). The releaser 90 is not in contact with the latch 81.

Figure 11B:
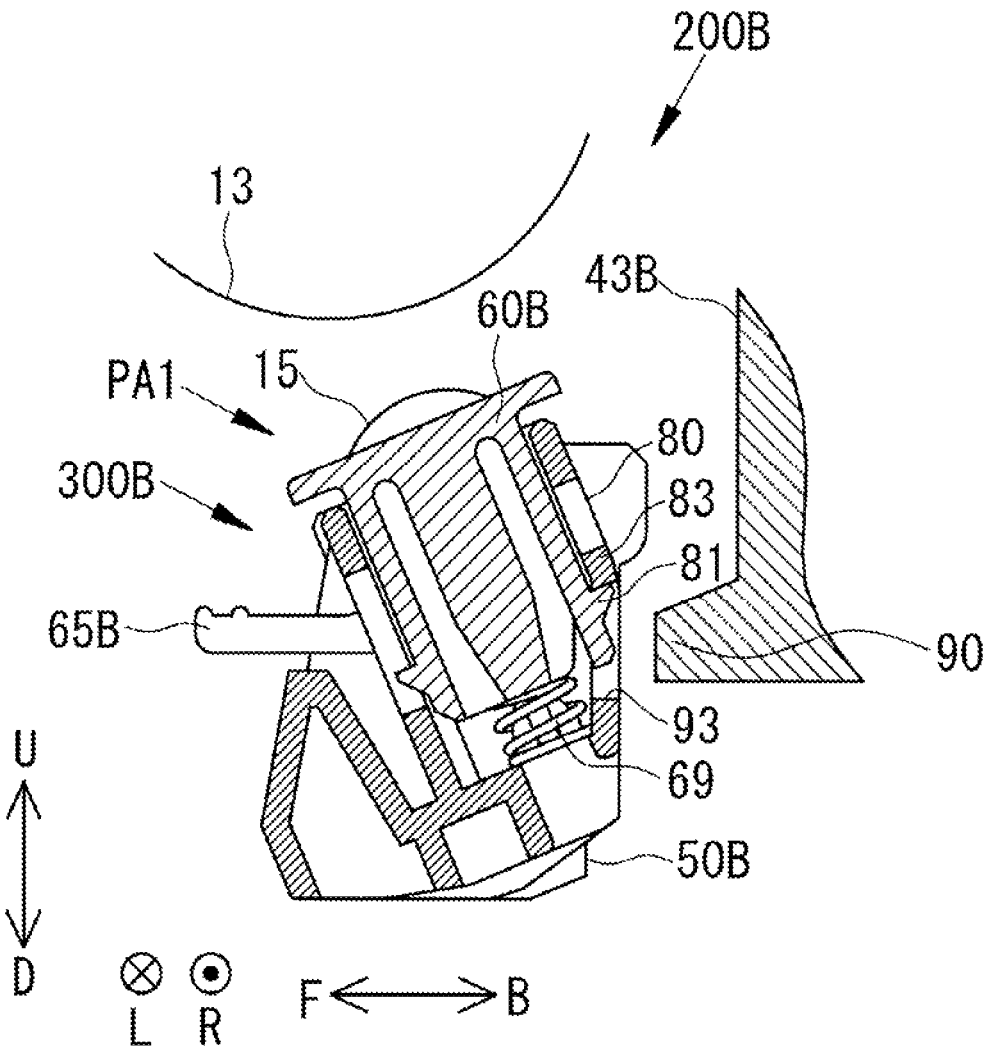
FIG. 11B is a cross-sectional view of the process cartridge and the charge roller unit according to the third embodiment in a state in which the charge roller unit is to be attached to the process cartridge.

In FIG. 11B, the charge roller unit 300B is attached to the storage recess 43B in the process cartridge 200B, and the releaser 90 is in contact with the latch 81. In the state illustrated in FIG. 11B, the engagement between the latch 81 and the latched portion 83 is not released, and the charge roller 15 is positioned at the remote position PA1.

Figure 12A:
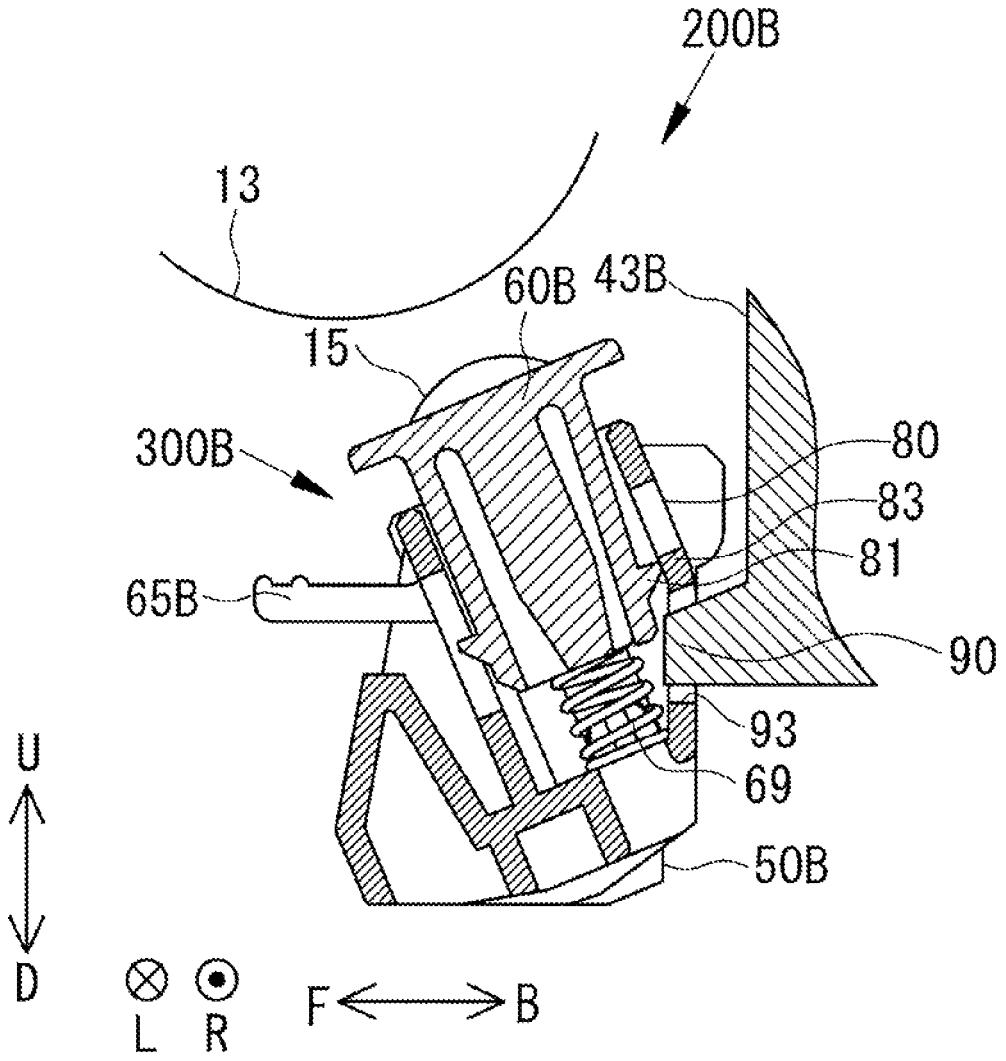
FIG. 12A is a cross-sectional view of the process cartridge and the charge roller unit according to the third embodiment in a state in which the charge roller unit is to be attached to the process cartridge.

FIG. 12A illustrates a state in which the charge roller unit 300B is completely attached to the storage recess 43B in the process cartridge 200B, and the engagement of the latch 81 and the latched portion 83 is released by the releaser 90. Since the engagement of the latch 81 and the latched portion 83 is released, the position of the charge roller 15 (the support 60B) is shifted from the remote position PA1 toward the contact position PA2 by the urging force of the urging member 69.

Figure 12B:
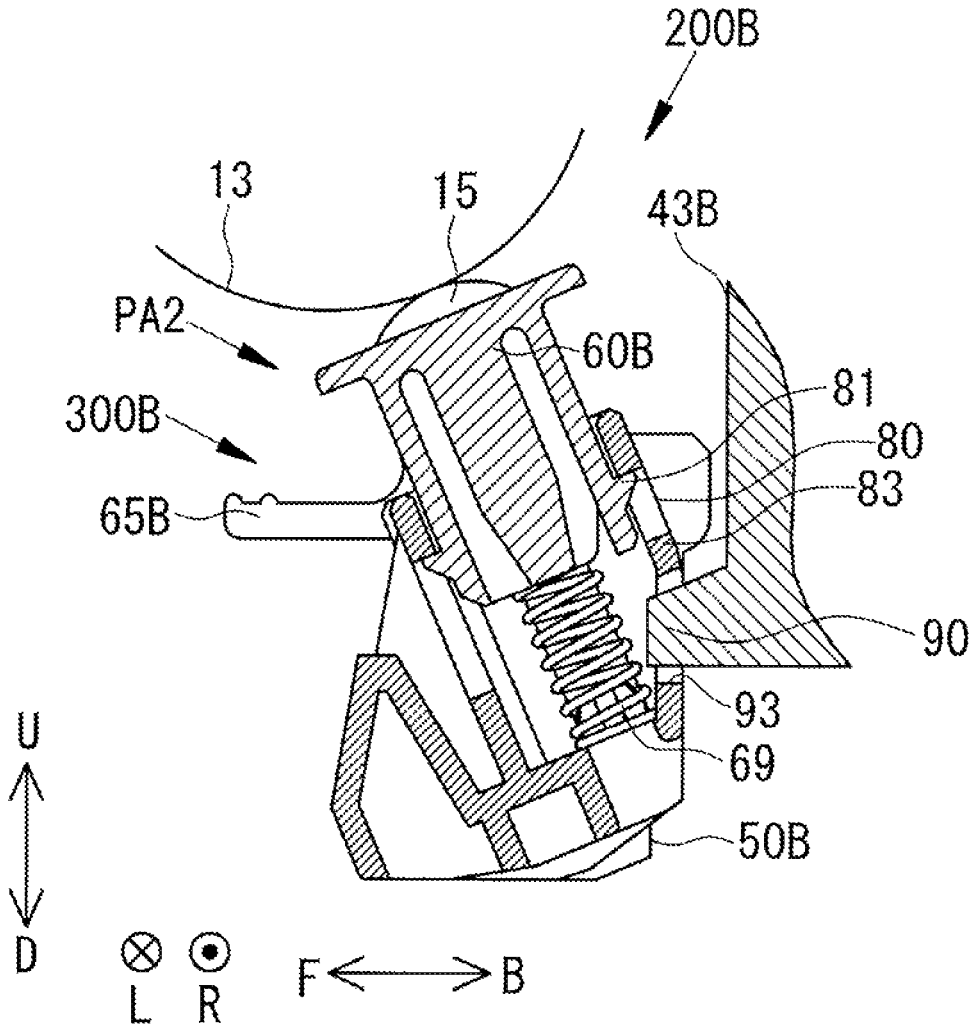
FIG. 12B is a cross-sectional view of the process cartridge and the charge roller unit according to the third embodiment in a state in which the charge roller unit is to be attached to the process cartridge.

FIG. 12B illustrates a state in which the charge roller unit 300B is attached to the storage recess 43B in the process cartridge 200B, and the position of the charge roller 15 (the support 60B) is switched from the remote position PA1 to the contact position PA2 by the urging force of the urging member 69.

When the charge roller unit 300B is to be removed from the storage recess 43B of the process cartridge 200B, a procedure opposite to that of the attachment procedure is performed. The position of the charge roller 15 is switched from the contact position PA2 to the remote position PA1, i.e., from the state illustrated in FIG. 12B to that in FIGS. 12A and 11B, by pressing down an operation portion 65B. When the position of the charge roller 15 is switched to the remote position PA1, the latch 81 and the latched portion 83 are engaged with each other, and the position (the remote position PA1) of the charge roller 15 (the support 60B) is retained. At this time, the latch 81 comes into contact with the releaser 90 and causes the charge roller unit 300B to be slightly pushed out from the storage recess 43B in the process cartridge 200B.

Then, as illustrated in FIG. 11A, the charge roller unit 300B is removed from the storage recess 43B in the process cartridge 200B while the position (the remote position PA1) of the charge roller 15 (the support 60B) is retained by the retainer 80.

In the process cartridge 200B according to the embodiment described above, the charge roller unit 300B has the retainer 80 that retains the charge roller 15 at the remote position PA1. Therefore, when the charge roller unit 300B is to be detached from or attached to the storage recess 43B, the position of the charge roller 15 can be switched to the remote position PA1 in advance so as to facilitate the detachment and attachment of the charge roller unit 300B.

By storing the charge roller unit 300B in the storage recess 43, the retained state of the retainer 80 is released, and the position of the charge roller 15 is switched from the remote position PA1 to the contact position PA2. Therefore, the operation of releasing the retained state of the retainer 80 is not required, and maintenance work, such as replacement of the charge roller 15, can be facilitated and made more efficient.

The present invention can be implemented in various other forms without departing from the spirit or principal features of the invention. Therefore, the above-described embodiments are mere examples and should not be limitedly interpreted. All modifications and changes belonging to the equivalent scope of the claims of the present invention are within the scope of the present invention.

EXPLANATION OF SYMBOLS

100 image forming apparatus
200 process cartridge
300 charge roller unit
13 photosensitive drum
15 charge roller
16 charge cleaning roller
40 body frame
43 storage recess
60 support
PA1 remote position
PA2 contact position

What is claimed is:

1. A process cartridge comprising:

a photosensitive drum disposed on a body frame;

a charge roller unit that includes a charge roller disposed in parallel with an axial direction of the photosensitive drum and that is provided separately from the body frame; and a storage recess that stores the charge roller unit, wherein, the charge roller unit includes:

a storage frame; and a support that supports the charge roller and is movably held relative to the storage frame, the support includes an operation portion that switches between a remote position and a contact position, the remote position being a position at which the charge roller is separated from the photosensitive drum while the charge roller unit is stored in the storage recess, the contact position being a position at which the charge roller is in contact with the photosensitive drum while the charge roller unit is stored in the storage recess, and the charge roller is moved from the contact position to the remote position by operating the operation portion.

2. The process cartridge according to claim 1, wherein, in the charge roller unit, the charge roller is switched to the remote position when the operation portion is operated.

3. The process cartridge according to claim 1, wherein, the charge roller is positioned at a predetermined position on a rear side of the photosensitive drum when viewed from a direction in which the charge roller unit is inserted to the storage recess, and the charge roller unit is detachable from and attachable to the storage recess by switching the support to the remote position while the charge roller is separated from the photosensitive drum.

4. The process cartridge according to claim 1, wherein, when a face viewed from a direction in which the charge roller unit is inserted to the storage recess is defined as a front face, the operation portion extends toward the front face.

5. The process cartridge according to claim 1, wherein the operation portion extends in an axial direction of the charge roller.

6. The process cartridge according to claim 1, wherein the charge roller unit includes a retainer that retains the charge roller at the remote position.

7. The process cartridge according to claim 6, wherein the storage recess includes a releaser that releases a retained state of the retainer and switches the charge roller from the remote position to the contact position, while the charge roller unit is stored in the storage recess.

8. An image forming apparatus comprising:

the process cartridge according to claim 1.

* * * * *